US007311025B1

(12) United States Patent
Wilson, Jr.

(10) Patent No.: US 7,311,025 B1
(45) Date of Patent: Dec. 25, 2007

(54) POWERED DRIVER WITH LOCATION SPECIFIC SWITCHING

(75) Inventor: David Wilson, Jr., Boulder, CO (US)

(73) Assignee: American Power Tool Company, Wellington, CO (US)

( * ) Notice: Subject to any disclaimer, the term of this patent is extended or adjusted under 35 U.S.C. 154(b) by 0 days.

(21) Appl. No.: 11/634,695

(22) Filed: Dec. 6, 2006

(51) Int. Cl.
*B25B 23/145* (2006.01)
*B25B 23/147* (2006.01)
*B25B 21/00* (2006.01)

(52) U.S. Cl. ..... 81/429; 81/467; 81/57.13

(58) Field of Classification Search ..... 81/429, 81/467, 479, 57–57.14, 57.16, 57.28–57.34, 81/58.2

See application file for complete search history.

(56) References Cited

U.S. PATENT DOCUMENTS 2,854,755 A 10/1958 Knobel
2,995,738 A 8/1961 Masek
3,289,310 A 12/1966 Stone
3,581,607 A * 6/1971 Rogers ..... 81/429
3,724,964 A 4/1973 Needham, Jr.
4,095,325 A * 6/1978 Hashimoto et al. ..... 29/407.03
4,330,052 A 5/1982 Schymick
4,335,516 A 6/1982 Edelstein
4,909,683 A 3/1990 Kopidlowski et al.
5,460,062 A 10/1995 Wilson, Jr.
5,537,897 A 7/1996 Wilson, Jr.
5,609,077 A * 3/1997 Ohmi et al. ..... 81/57.13

* cited by examiner

*Primary Examiner*—David B. Thomas
(74) *Attorney, Agent, or Firm*—Harold A. Burdick

(57) ABSTRACT

Powered drivers and methods are disclosed, the drivers including a head housing a motor driven drive transfer assembly for operating a rotatable socket engageable at a threaded connector. A reaction unit having a fitting engagement attached to rail guides is movably maintained through the head. A biasing unit is maintained at the head and is operatively associated with the rail guides of the reaction unit to bias the fitting engagement of the reaction unit toward the rotatable socket during tightening rotation of the engaged threaded connector. A probe and switch are associated with different ones of the reaction unit and the head, and are brought into operative association at selected relative locations of the reaction unit and the head during connector rotation to cause motor cessation.

20 Claims, 14 Drawing Sheets

POWERED DRIVER WITH LOCATION SPECIFIC SWITCHING

FIELD OF THE INVENTION

This invention relates to drivers for tools, and, more particularly, relates to powered nut drivers.

BACKGROUND OF THE INVENTION

Powered drivers, both pneumatic and electrical, for manipulation of various types of tools such as sockets for threaded connectors are well known. In many applications, such as manipulation of threaded line fittings (i.e., unions or the like) found in all gas or liquid processing or delivery operations and assemblies, the tightness of the fitting is critical to assure a sound connection and to avoid leakage (which may occur if line fittings are either over or under tightened).

Numerous approaches to gauging the correct tightness of such connectors have been heretofore suggested and/or utilized, with varying degrees of success. Torque requirements for driving large and small fasteners varies such that the same driver often can not be employed for different fasteners. Moreover, devices and methods for gauging fitting integrity during fitting installation that are used for pneumatic tools are frequently not applicable for electrical drivers and vice versa. Such heretofore known approaches are often not highly accurate and repeatable, and/or are quite expensive computer-based applications of limited utility in the field. Further improvement of such drivers and driving methods could thus still be utilized.

SUMMARY OF THE INVENTION

This invention provides improved drivers and methods for manipulating threaded connectors that accommodate repeated precise tightening of threaded connectors based on location specific switching. The driver of this invention is capable of application over a wide variety of fastener types, independent of torque requirements and/or fastener size. The drivers and methods of this invention are appropriate for both pneumatic and electrical applications. Specified fastener tightening using the drivers and methods of this invention is highly accurate and repeatable, while yet maintaining a cost effective tool for both manufacturing and field applications.

Correct tightening of a connector (based on manufacturers' specifications typically expressed in either torque or rotations after "finger tight") is achieved by gauging the distance between two parts of the driver that move in a manner relative to one another correlated to the movement of the fastener, automatic cessation of driver rotation occurring upon achievement of selected relative locations of the two parts corresponding to the specified fastener tightness.

The driver includes a head that houses a drive transfer assembly for operating a rotatable socket that is engageable at the threaded connector. A force applying means applies motive force to the drive transfer assembly. A reaction unit movably maintained at the head is engageable at a utility related to the threaded connector (for example, a second part of a line fitting, screwing surface, bolt head, nut or the like), and is biased toward the rotatable socket during tightening rotation of the engaged threaded connector. A switching arrangement includes components associated with both the reaction unit and the head which are brought into operative association at selected relative locations of the reaction unit and the head to decouple the force applying means.

The force applying means may be either a pneumatic or electrical motor and related controllers (where present). The reaction unit includes a fitting engagement attached to at least one rail guide movably maintained through the head. At least one biasing unit is maintained at the head and is operatively associated with the rail guide of the reaction unit to bias the fitting engagement of the reaction unit toward the rotatable socket. The switching arrangement preferably includes a probe connected with the reaction unit and a switch operatively associated with the motor and mounted at the head at a position to be contactable by the probe.

The method of this invention is particularly directed to reliably repeatable rotation of threaded line fitting nuts to a selected tightness. The method includes steps of engaging the nut at a rotatable socket and rotating the nut in one direction. Another part of the line fitting is engaged at a reaction unit movably maintained adjacent to the socket. The reaction unit is biased toward the socket during rotation of the engaged nut in the one direction. The distance between the reaction unit and the socket is probed during rotation in the one direction, and, responsive to the probing, rotation is ceased when a selected relative location of the reaction unit and the socket is achieved corresponding to selected nut tightness.

It is therefore an object of this invention to provide improved drivers and methods for manipulating threaded connectors.

It is another object of this invention to provide drivers and methods for manipulating threaded connectors that accommodate repeated precise tightening of threaded connectors based on location specific switching.

It is still another object of this invention to provide correct tightening of a threaded connector by gauging the distance between two parts of a driver that move in a manner relative to one another correlated to the movement of the fastener during tightening.

It is yet another object of this invention to provide powered nut drivers and methods that provide automatic cessation of driver rotation upon achievement of selected relative locations of two movable parts of the driver corresponding to correct nut tightness.

It is another object of this invention to provide a powered tool driver capable of application with a wide variety of connector and fastener types, torque requirements and/or size, that is adaptable for both pneumatic and electrical applications, and that can achieve specified connector tightening in a highly accurate and repeatable manner.

It is yet another object of this invention to provide a powered driver for rotating a threaded connector, the driver including a head housing a drive transfer assembly operating a rotatable socket engageable at the threaded connector, means for applying motive force to the drive transfer assembly, a reaction unit engageable at a utility related to the threaded connector, the reaction unit movably maintained at the head and biased toward the rotatable socket at least during rotation of an engaged threaded connector in one direction, and switching with components associated with both the reaction unit and the head that are operatively associated to provide triggering at selected relative locations of the reaction unit and the head to decouple the means for applying motive force.

It is still another object of this invention to provide a powered driver for line fittings that includes a head housing a rotatable socket, a motor operatively associated with the rotatable socket, a reaction unit including a fitting engagement attached to rail guides movably maintained through the head, a biasing unit maintained at the head and operatively associated with the rail guides of the reaction unit to bias the fitting engagement of the reaction unit toward the rotatable socket, a probe connected with the reaction unit, and a switch operatively associated with the motor and mounted at the head at a position to be contactable by the probe.

It is another object of this invention to provide a method for reliably repeatable rotation of threaded line fitting nuts to a selected tightness that includes the steps of engaging the nut at a rotatable socket and rotating the nut in one direction, engaging another part of the line fitting at a reaction unit movably maintained adjacent to the socket and biasing the reaction unit toward the socket during rotation of the engaged nut in the one direction, gauging relative locations of the reaction unit and the socket during rotation in the one direction, and, responsive to the gauging, causing cessation of rotation when a selected relative location of the reaction unit and the socket is achieved corresponding to selected nut tightness.

With these and other objects in view, which will become apparent to one skilled in the art as the description proceeds, this invention resides in the novel construction, combination, and arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
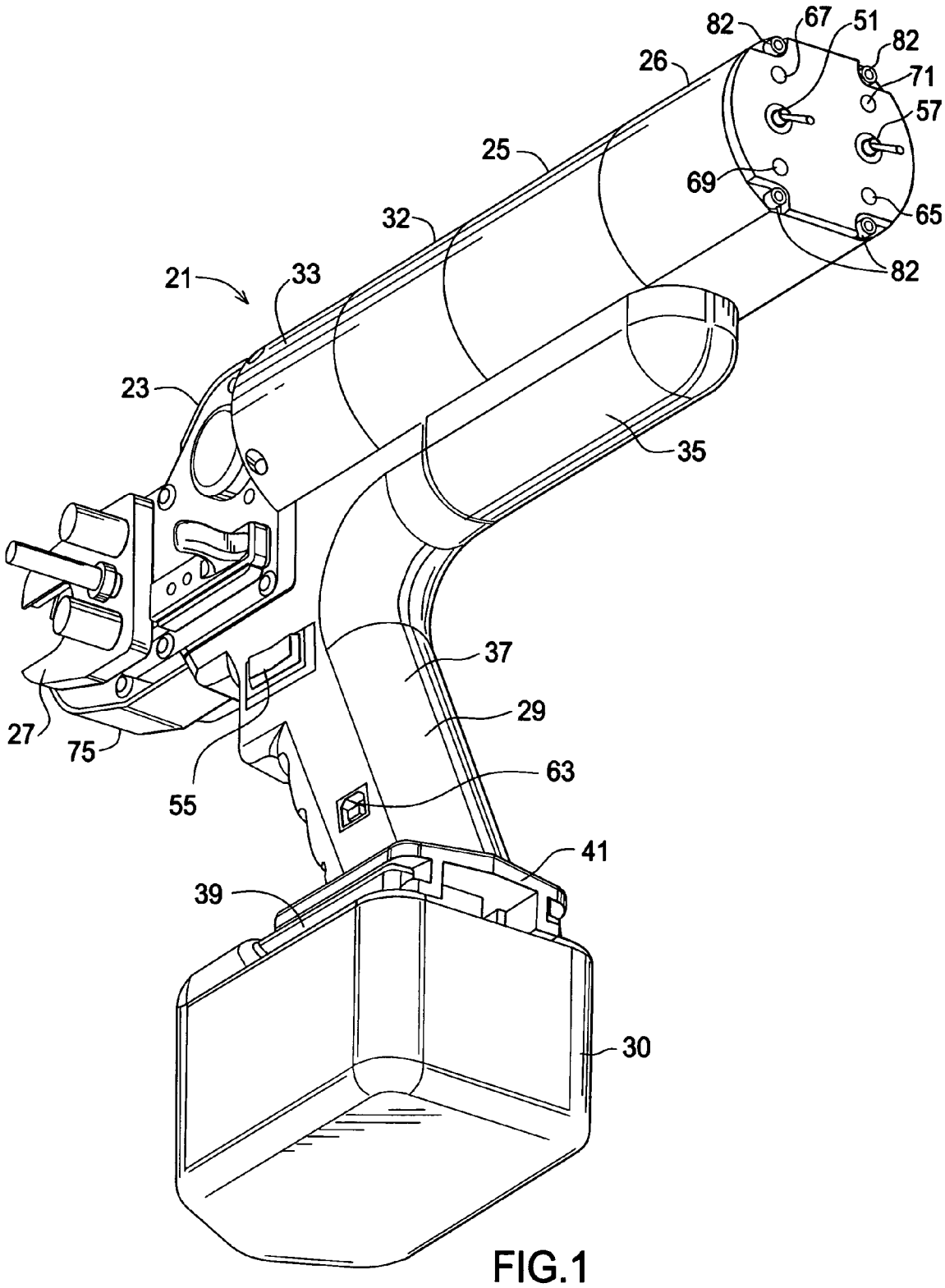
FIG. 1 is a perspective view showing the tool driver of this invention.
Figure 2:
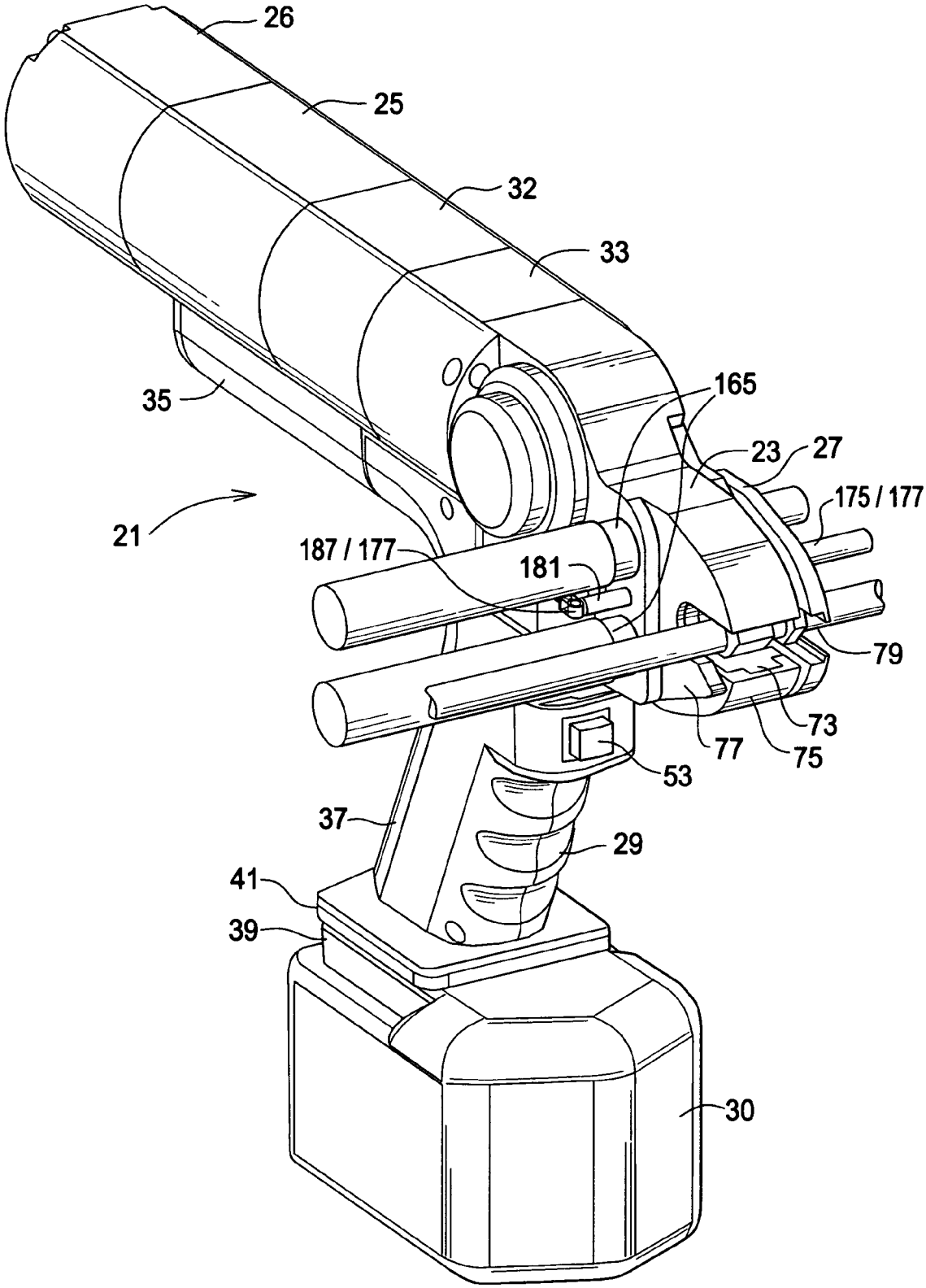
FIG. 2 is a reverse perspective view of the driver of FIG. 1.
Figure 3:
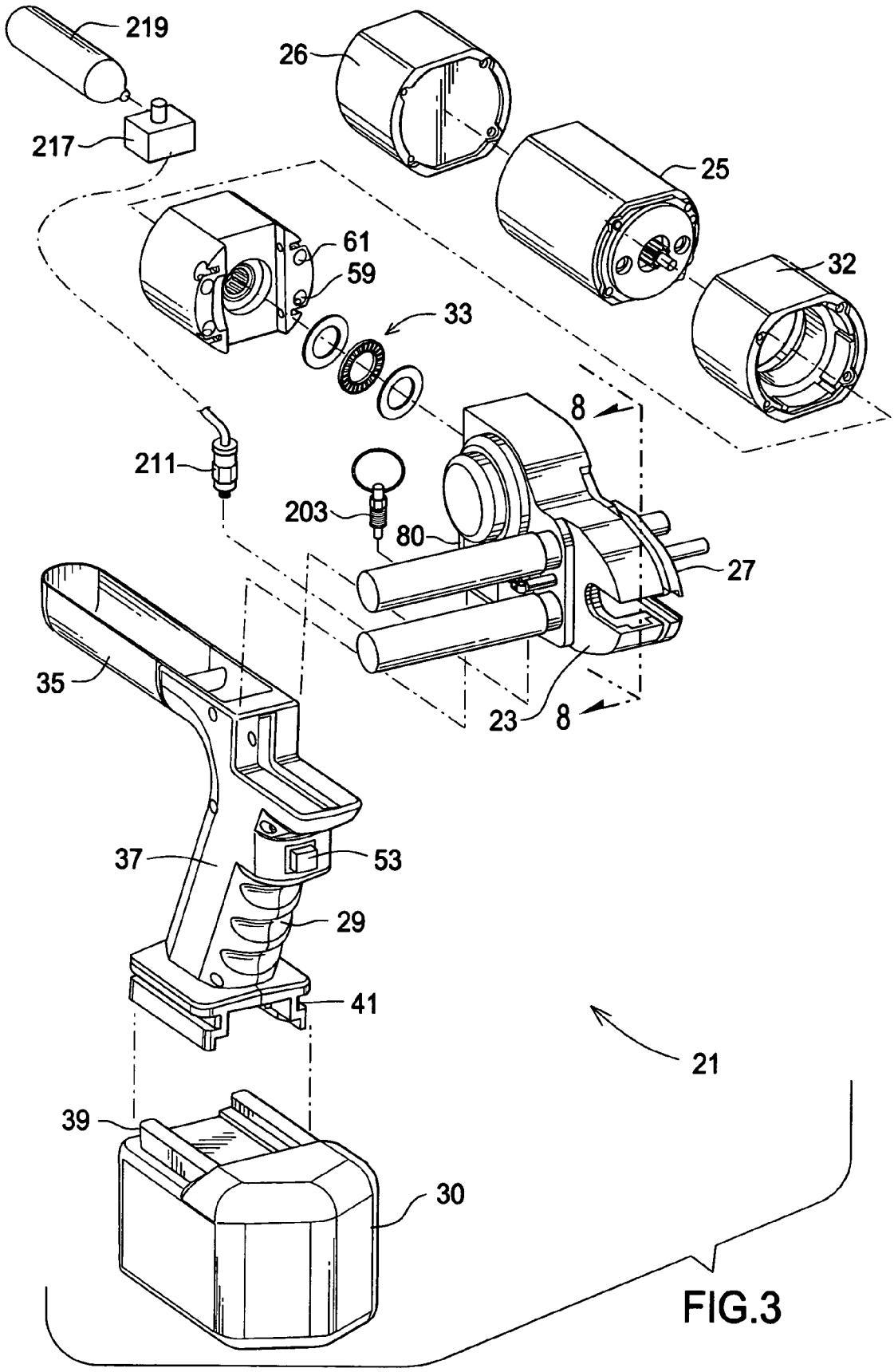
FIG. 3 is a partial exploded view of the housing and components of the driver of this invention.

Powered driver 21 of this invention, for rotating tools such as sockets or the like to manipulate threaded connectors, is illustrated in FIGS. 1 through 3. Driver 21 includes driver head 23, motor module 25 (any means of applying motive force could be used including electrical, pneumatic or fluid drive motors), electronics module 26, reaction unit 27, housing 29, and battery pack 30. Torque amplification drive train modules 32 and 33 provide a drive train capable of staged increase of torque from a motor 25 rating of about 0.18 ft.lbs. to over 35 ft.lbs., thereby accommodating connector manipulation in a wide variety of size and torque application categories (torque amplification is adaptable to requirements). Housing 29 is hollow at both barrel portion 35 and handle portion 37 thus providing the required space and protection for driver electrical components as hereinafter discussed. Battery pack 30 is of standard configuration and includes a standard conductive slide connector 39 (with mating unit 41 at handle portion 35) providing both connectivity and security of batteries in pack 30.

Figure 4:
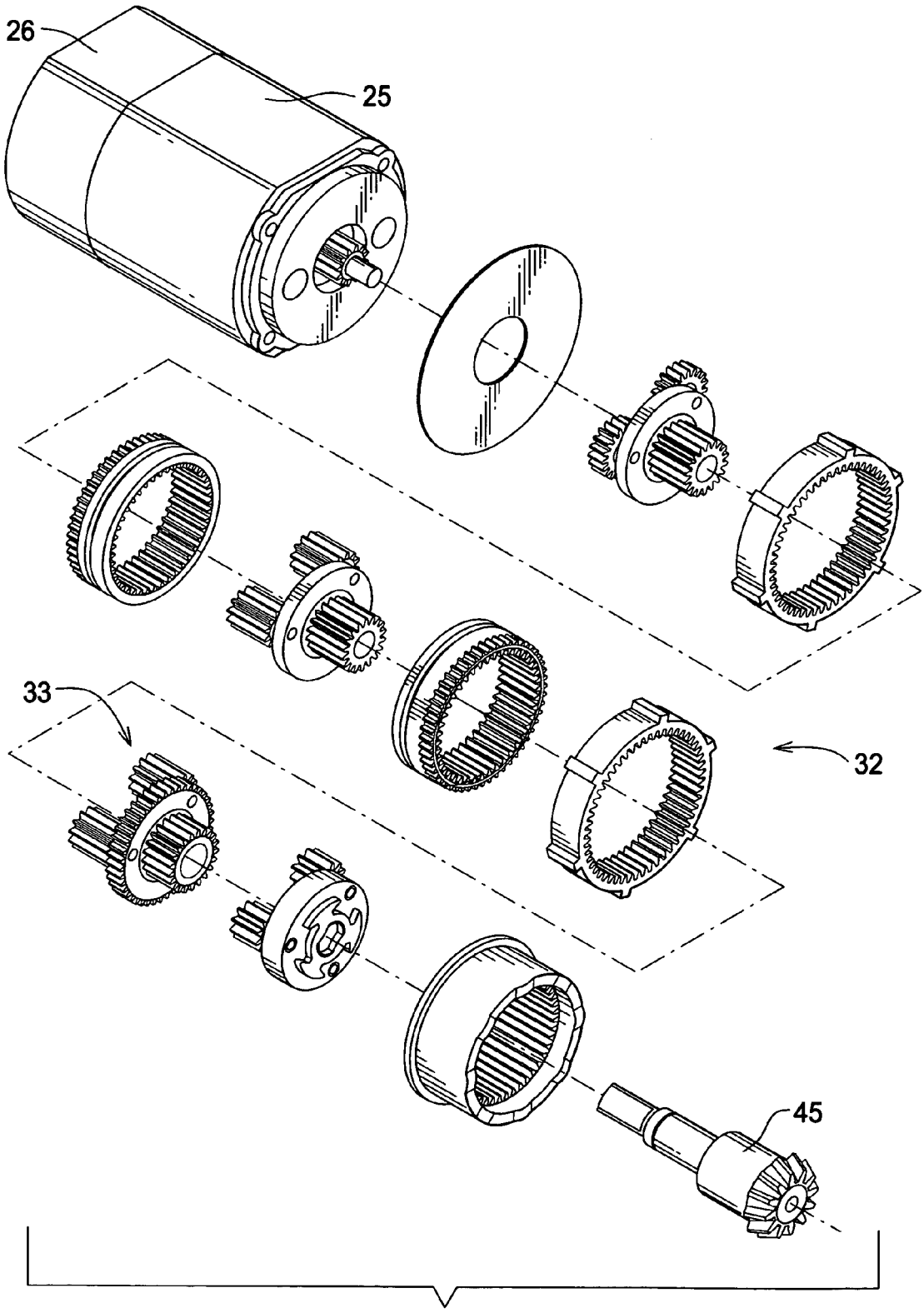
FIG. 4 a detailed exploded view of housed drive train elements not shown in FIG. 3.
Figure 5:
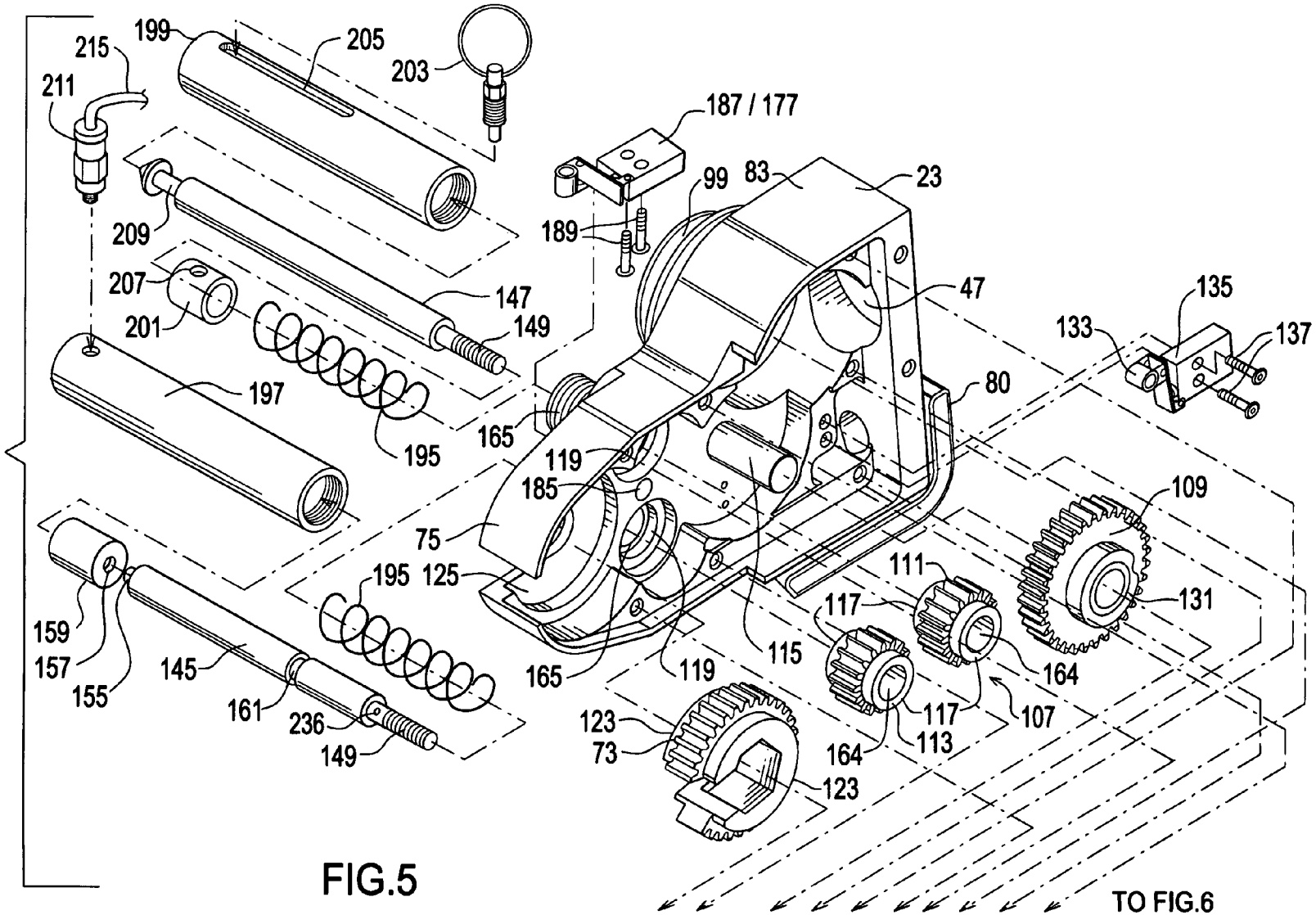
FIG. 5 is a partial exploded view of the driver head of the driver of this invention.
Figure 6:
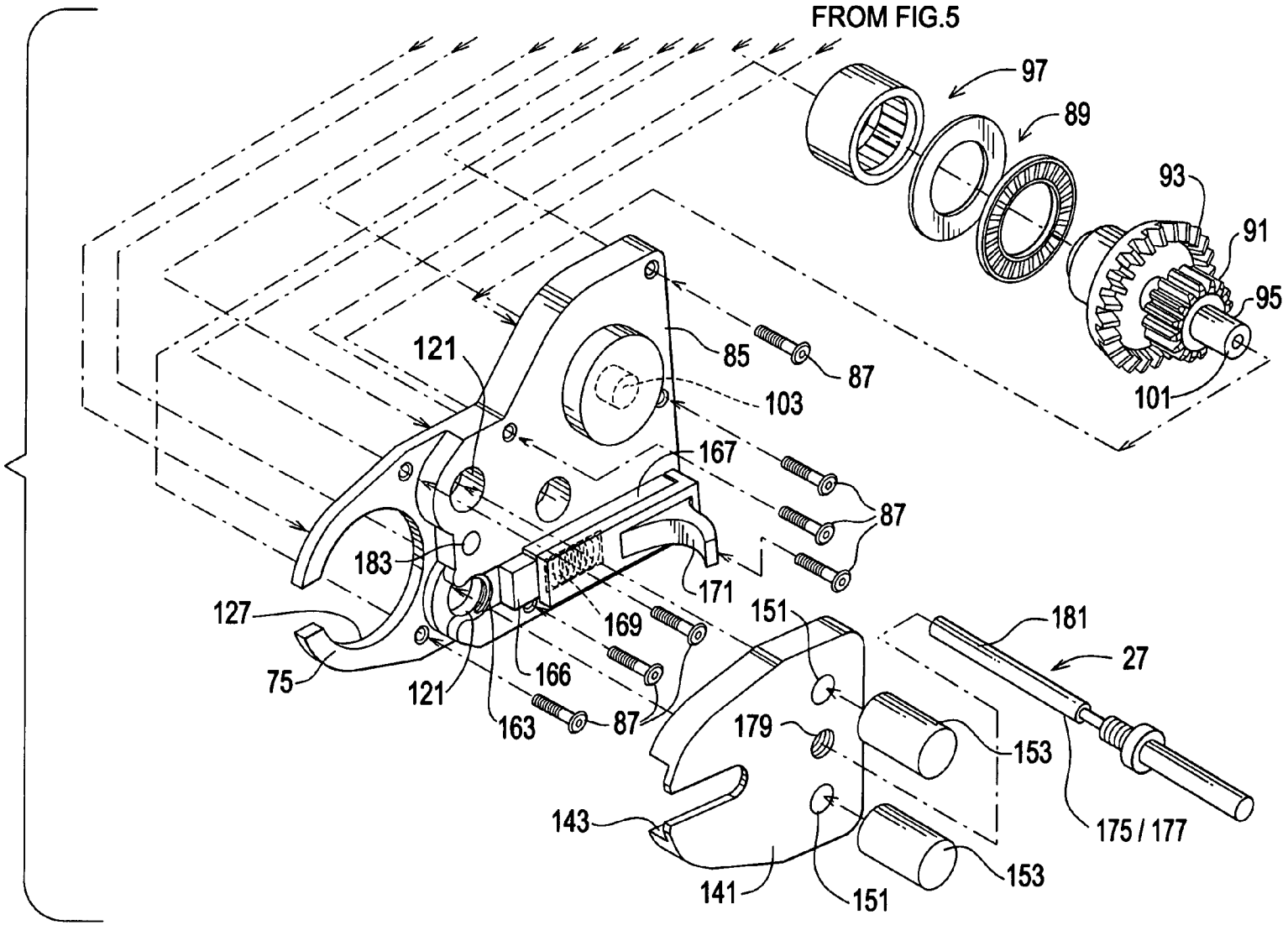
FIG. 6 is a second partial exploded view of the head of the driver of this invention.
Figure 7:
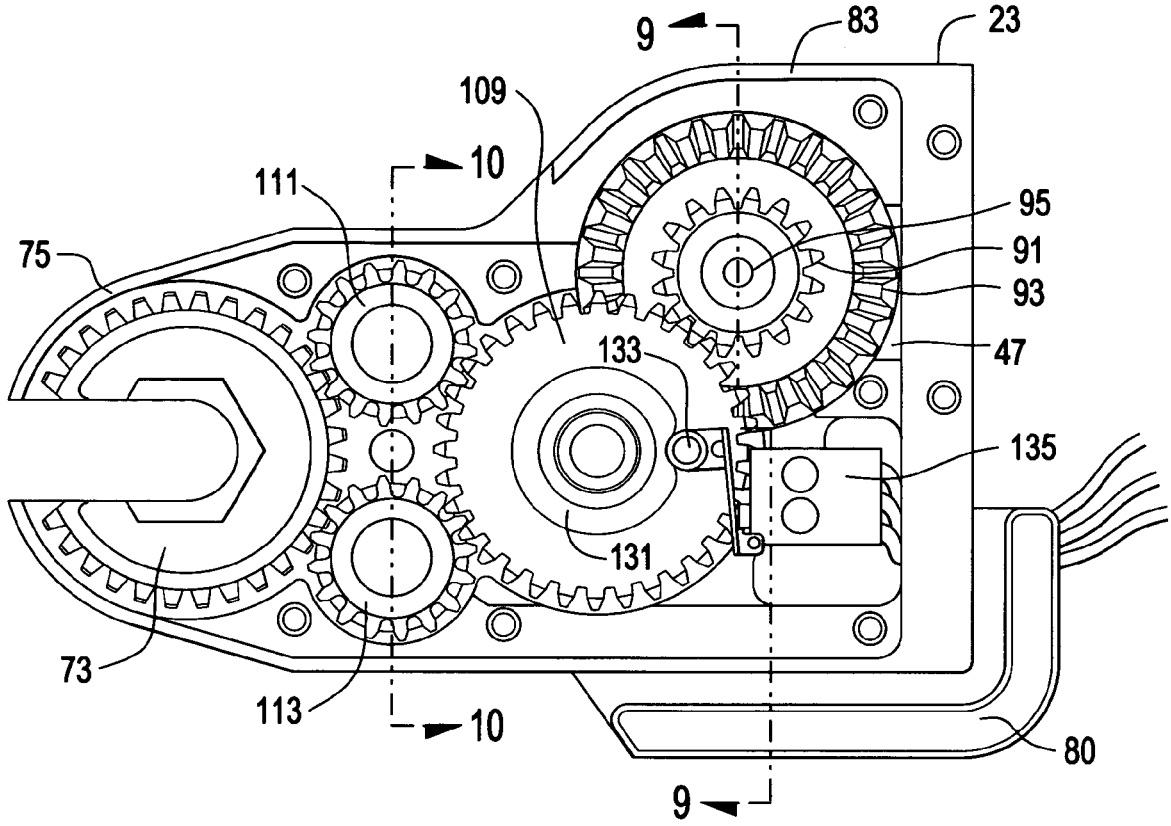
FIG. 7 an elevation view of the head of the driver of this invention with the top cover removed.
Figure 8:
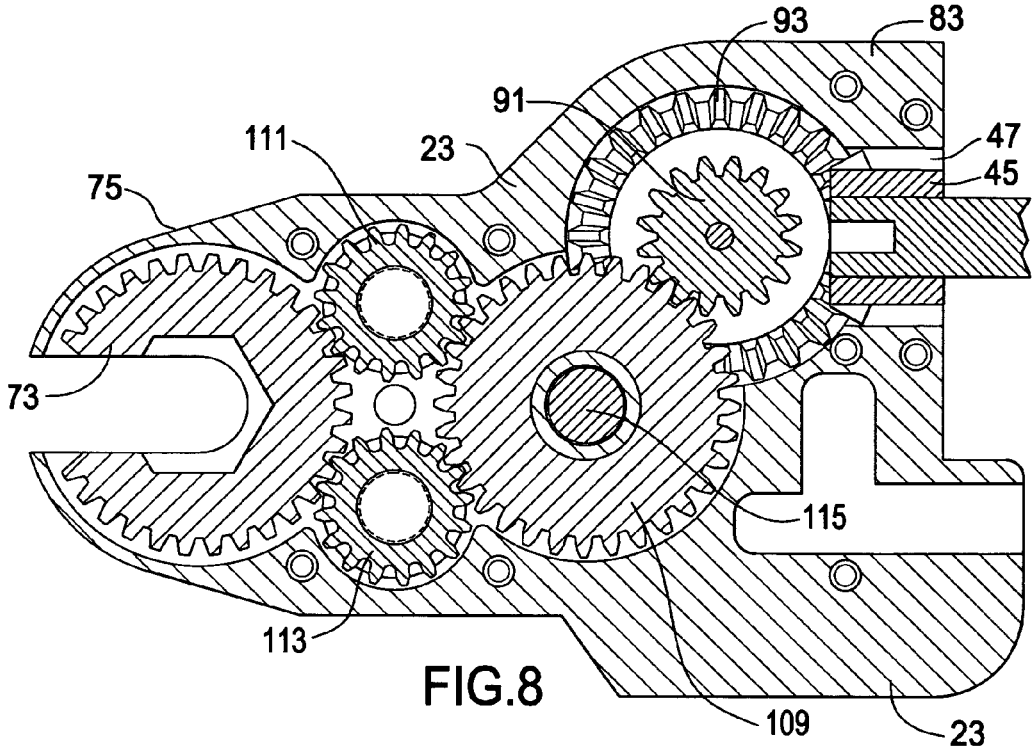
FIG. 8 is a sectional view taken along section lines 8-8 of FIG. 3.
Figure 9:
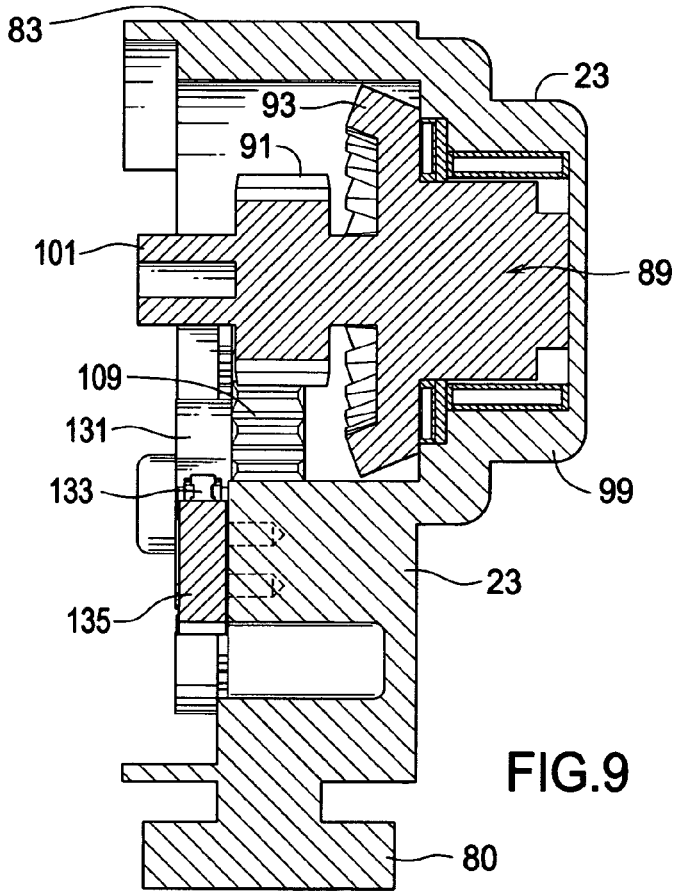
FIG. 9 is a sectional view taken along section lines 9-9 of FIG. 7.
Figure 10:
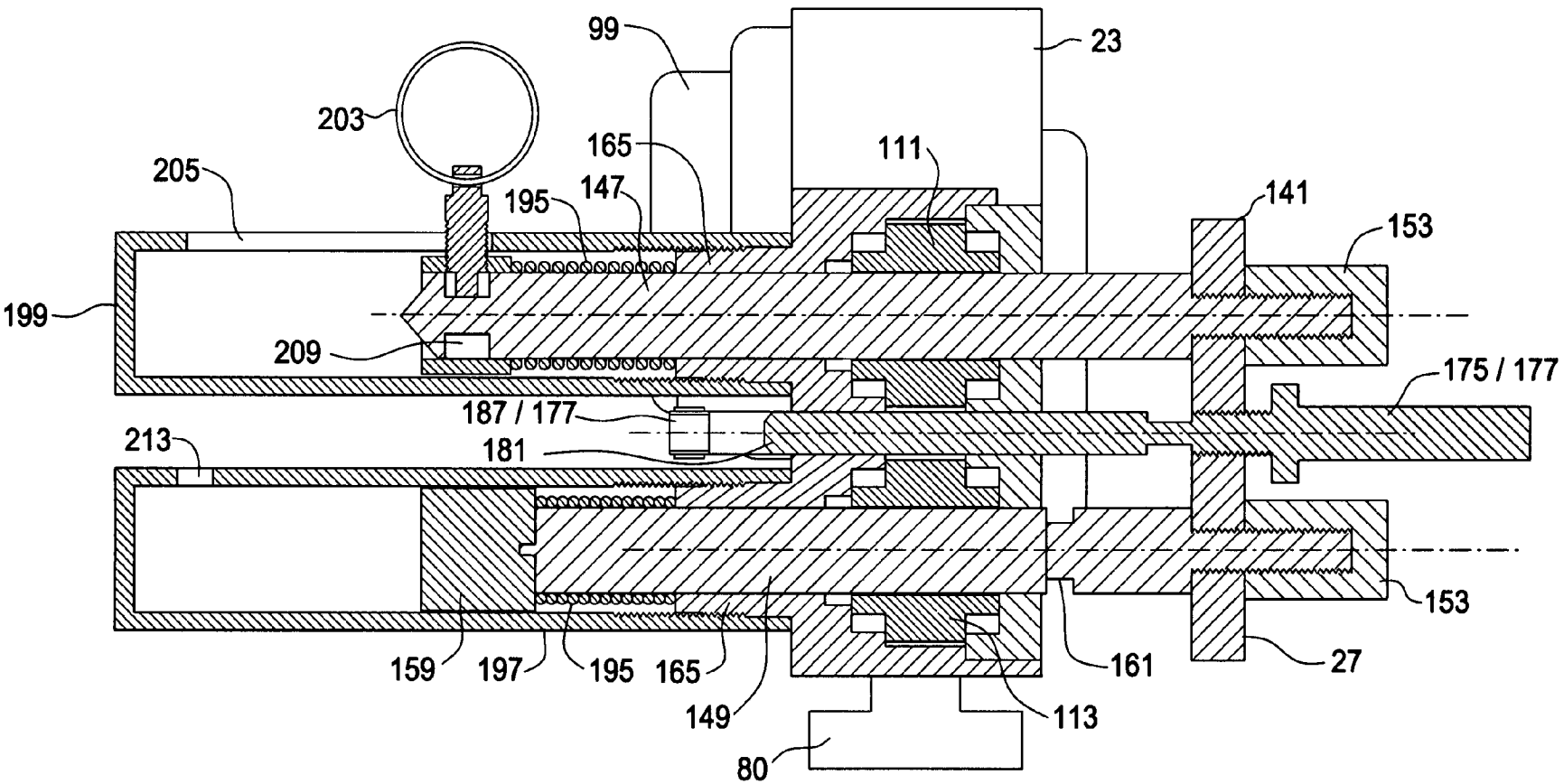
FIG. 10 is a sectional view taken along section lines 10-10 of FIG. 7 but with the top cover and reaction unit in place.

As shown in FIGS. 3 and 4, torque amplification modules 32 and 33 include discrete gear sets in separate housings to accommodate different torque output requirements in different tool configurations. The final output stage 33 includes primary drive output shaft and bevel gear 45 receivable through opening 47 at head 23 (see FIG. 5).

Operational switches, lights and ports are readily accessible, including main on/off switch 51, main operational running switch/trigger 53, forward and reverse jog rocker switch 55 (for advancing or retreating rotation by one to five degree increments), and lights switch 57 (operating white light 59 and red, night light 61). USB port 63 provides communication and data download capabilities (from onboard controller memory) as discussed hereinafter. Control lights 65, 67, 69 and 71 are provided to indicate tool on/off status (yellow—65) and socket status (67—green indicating socket 73 centering at jaw opening 75 and safety switch 77 tripped by placement of a line and fitting 79 (see FIG. 2)). Light 69 blinks (red) at each full rotation of socket 73, and thus a fitting engaged thereat, and light 71 indicates (blue) when the correct connector tightness (nut to fitting body gap, for example) has been achieved.

Housing 29 is preferably a split housing (as shown) held by common fastener techniques, with the housing, when assembled, capturing head 23 at mounting bracket 80. Modules 25, 26, 32 and 33 are affixed to one another and to head 23 utilizing standard screw type fasteners 82.

Turning now to FIGS. 5 through 10, head 23 and reaction unit 27 will be described in greater detail. Head 23 includes main body 83 and top cover 85 held together using screws 87. Gapped jaw 75 is utilized in this embodiment of the driver to accommodate use of a split socket tool 73 (a hex socket, for example) used to manipulate line fittings (79, as shown in FIG. 2). Drive translate assembly 89 includes stacked gears 91 and 93 on shaft 95 and bearing set 97 pressed into main body mounting 99, bevel gear 93 engaged by primary drive output gear 45 of final output stage 33 of torque amplification modules 32 and 33. The opposite end 101 of shaft 95 is rotatably fitted into mount 103 in cover 85.

Drive transfer gear assembly 107, including main drive gear 109 and idler gears 111 and 113, complete the drive train. Main drive gear 109 engages gear 91 of translate assembly 89 and is mounted on shaft 115 of main body 83. Idler gears 111/113 are used in split socket applications, providing constant drive application to socket 73, and are mounted on bearing shoulders 117 in housing detents 119 and cover openings 121. Socket 73 is mounted on bearing shoulder 123 in housing detent 125 and cover opening 127. Main drive gear 109 and socket 73 preferably are the same size and have the same gear tooth count, so that rotation thereof is one to one. Cam surface 131 is provided at gear 109 and follower 133, the roller of roller switch 135, is mounted at main body 83 adjacent thereto using screws 137. This arrangement provides indication of socket 73 rotation at light 69 as well as socket location (in degrees) and rotation counting in onboard controller software or firmware.

Reaction unit 27 includes fitting engagement 141 (gapped for receipt of line fittings as shown in this embodiment) for engaging a utility related to the connector being manipulated (for example, a line fitting body, the second part of a line fitting assembly not including the nut). Engagement 141 in this embodiment, for example, includes a sized slot 143 having surfaces configured to receive and securely hold a hexagonal fitting body. Rail guides 145 and 147 (a single guide could be utilized in some embodiments of the driver of this invention) are received at reduced diameter threaded ends 149 through openings 151 of engagement 141 and are held thereat by cap nuts 153.

Guide 145 includes second reduced diameter end 155 engageable (pressed into) opening 157 of piston 159. Guide 145 also includes intermediate annular slot 161 for capture and retention of reaction unit 27 by clip 163 at cover 85 (during fitting loading, reaction unit 27 must be held in an opened, disengaged position, since, as will be appreciated, the entire unit 27 is spring biased). Guides 145 and 147 are receivable through openings 121 in cover 85, through openings 164 of idler gears 111 and 113, and the openings into body 83 through threaded shoulders 165.

Clip 163 is mounted at the end of spring biased latch body 166 held in latch mount 167 attached to cover 85. Spring 169 is held in mount 167 between body 166 and mount 167 and biases body 166 so that clip 163 is urged toward and across one opening 121 of cover 85 and into engagement with rail guide 145. Release grip 171 protrudes from body 166 allowing user access for movement of latch body 166. Sliding movement of reaction unit 27 on guides 145 and 147 (against unit bias as discussed hereinafter) away from head 23 eventually results in movement of clip 163 into engagement at annular slot 161 thus allowing cocked retention of reaction unit 27 at this position. Once a fitting is correctly positioned at the driver, retraction of latch body 166 using release grip 171 by a user frees clip 163 from slot 161 allowing movement of unit 27 toward head 23 and into correspondence with a connector utility at engagement 141.

Figure 11:
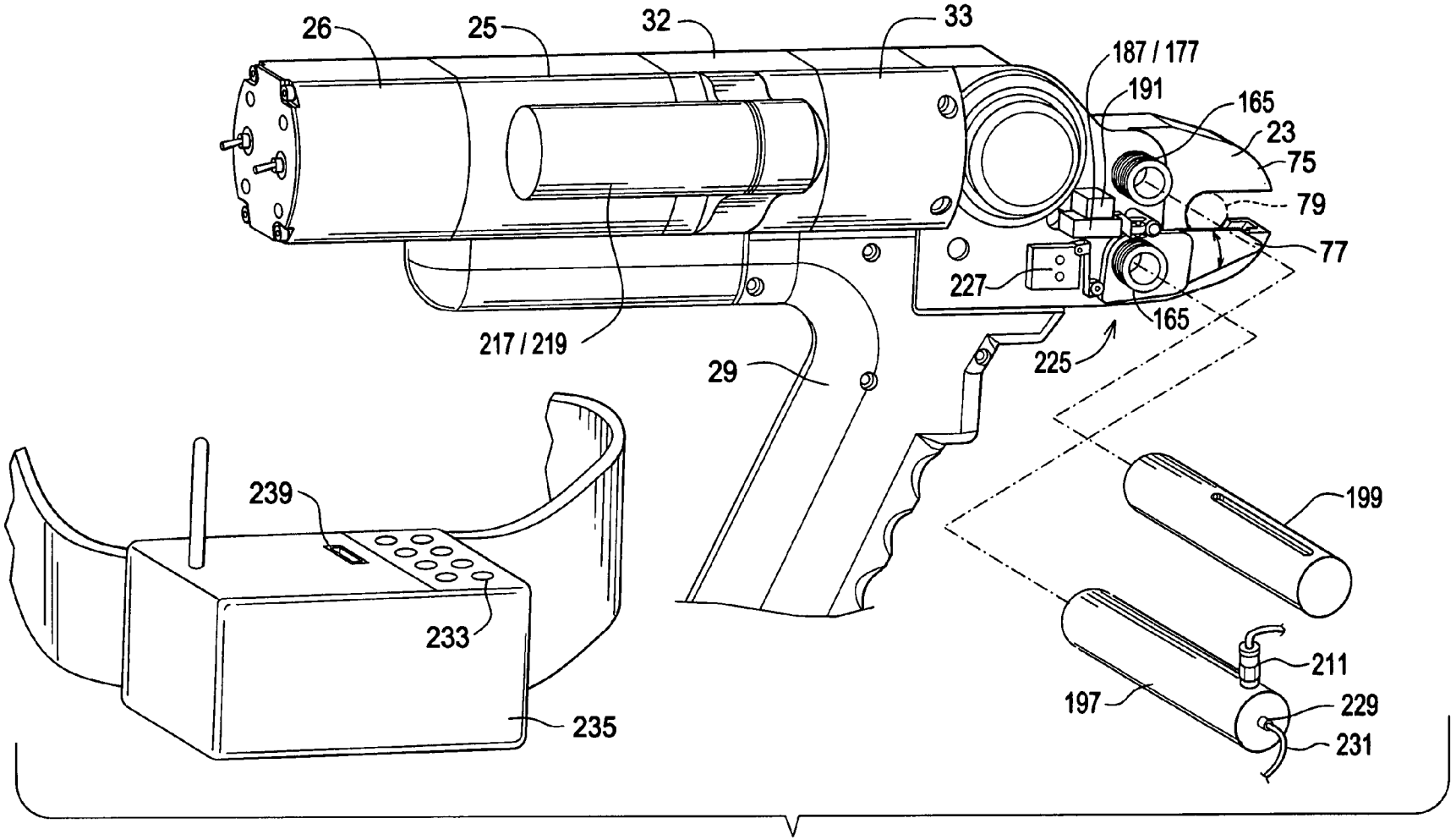
FIG. 11 is a partially exploded perspective view showing additional features which may accompany the driver of this invention.

Probe component 175 of switching assembly 177 is threadably received through opening 179 of engagement 141, probe reach being adjustable by extent of threaded engagement. Probe end 181 is receivable through openings 183 and 185 in cover 85 and body 83, respectively. Switch component 187 of assembly 177 (a roller switch, for example) is attached by screws 189 to a mounting block 191 (as shown in FIG. 11) on body 83 to position the roller of roller switch 187 over opening 185 and thus in the path of probe end 181. Switch component 187 is operatively linked (through controls as shown hereinafter) with the main motor of the driver to decouple motive force when tripped by probe end 181.

Engagement 141 of reaction unit 27 is biased toward driver head 23 (and particularly toward socket 73) by springs 195 in closed ended retainers 197 and 199 threadably engaged at shoulders 165. Springs 195 are maintained between shoulders 165 and piston 159 at retainer 197 and slide 201 at retainer 199 thus biasing the piston and the slide (and so guides 145 and 147 and the rest of reaction unit 27) toward the closed ends of the retainers 197 and 199. Slide 201 is retained at the end of guide 147 by manually releasable spring clip 203 received through slide slot 205, threaded opening 207 in slide 201 and annular slot 209 at guide 147. When spring clip 203 is retracted from slot 209 thus releasing guide 147, reaction unit 27 may be fully withdrawn from head 23.

As may be appreciated, as a fitting nut is tightened on a fitting body using the driver of this invention, engagement 141 of reaction unit 27 in contact with the fitting body is biased toward socket 73 at the same rate as the nut moves toward the fitting body. At the same time, probe end 181 is proceeding at this rate toward switch component 187. By virtue of probe length and/or geometry selection (either factory selected for particular operations, threadably adjustable, or by selection and installation of one of a variety of probe components having different selected lengths for different fitting specifications), switch contact occurs when correct connector or fitting (nut to body gap) tightness is achieved thereby causing cessation of socket rotation. Such operations are highly predictable and thus repeatable. Since most motor and drive trains have overrun (i.e., a few degrees of continued rotation due to system momentum), the driver is programmed with an automatic reverse rotation at the end of the tightening cycle corresponding to estimated system overrun to relieve system tension without changing nut torque. Use of the jogging function can provide further tightening or loosening as desired. After disengagement from a tightened fitting, split socket 73 is run to the gap centered position relative to jaw opening 75 (for example, in a fully automated mode, by a subsequent press of trigger switch 53 after release thereby running socket 73 to the centered position—indicated by light 67—and resetting the driver for a new connector driving cycle).

Reaction unit 27 may be manually reset for a new cycle ("cocked" as described above) or may be reset by pneumatic means as shown herein. Pneumatic fitting 211 is threaded at opening 213 of retainer 197 and connected by line 215 with valve 217 and pressurized gas cylinder 219. After a fitting is tightened, triggering valve 217 causes a burst of gas to enter retainer 197 through opening 213 forcing piston 159 against spring bias to move guide 149 (and thus unit 27, releasing and resetting switch component 187) until slot 161 captures spring biased retaining clip 163.

Figure 12:
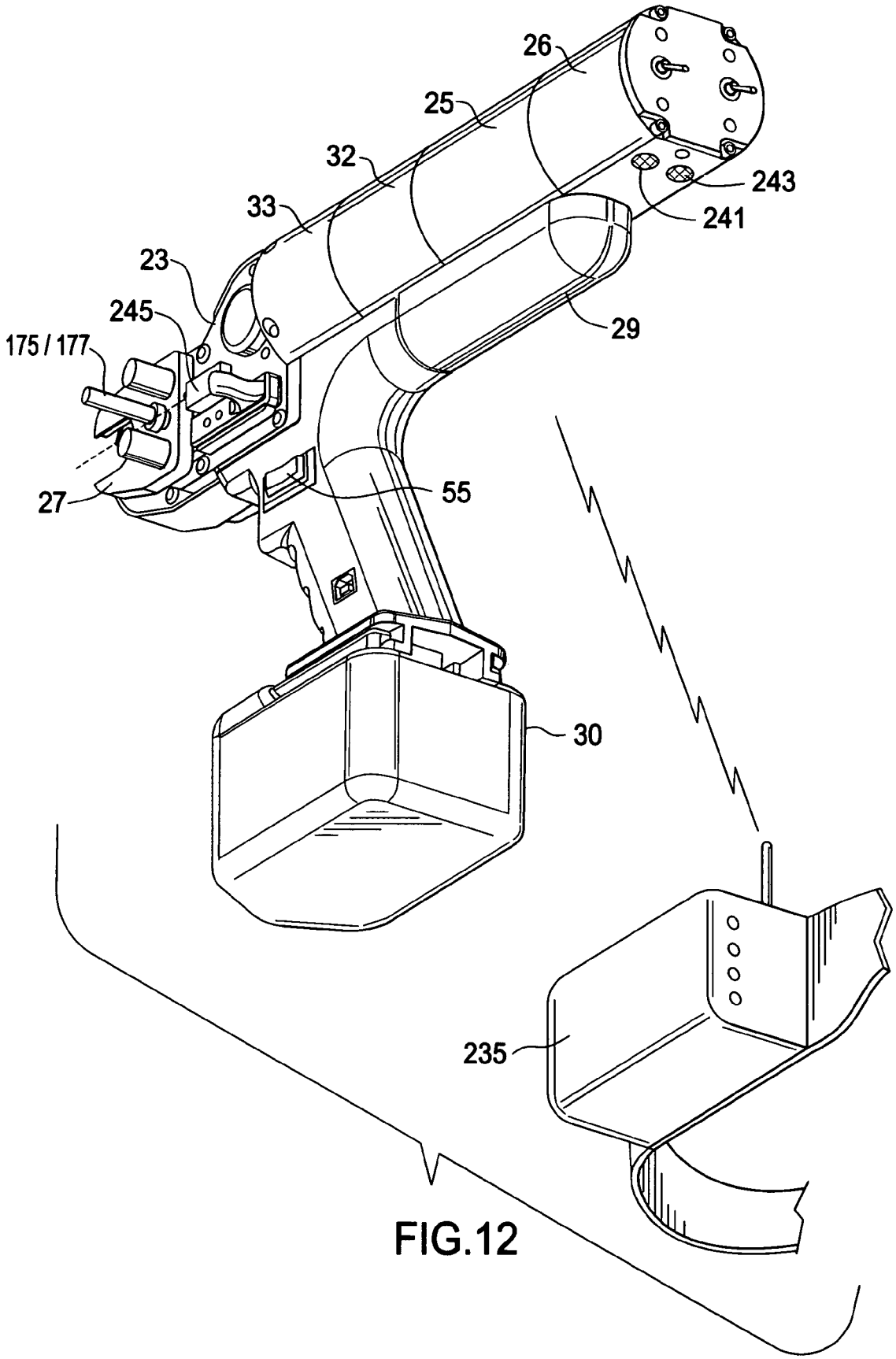
FIG. 12 is a perspective view illustrating still other additional features which may accompany the driver of this invention.

Turning to FIGS. 11 and 12, several additional driver features may be provided to enhance safety and utility. Safety switch assembly 225 includes switch 77 pivotably biased to a position closing gapped jaw 75. When forced open by a line or other fitting 79, switch 77 geometry causes engagement at roller switch 227 attached to head 23 thereby electrically enabling driver operation. A second pneumatic fitting 229 is positioned for access to the interior of retainer 197. Line 231 connected with fitting 229 is received at port 233 of a test fixture 235 to thereby receive continuously aspirated samples from the fitting\connector union area through retainer 197 and bore hole 236 through guide 145 (see FIG. 5). Leak detection at a fitting may thus be accommodated.

Test fixture 235 may be belt mounted, as shown, and may include a USB input 239 (for communication through the USB port at the driver or with a base computer). BLUE TOOTH and/or radio communication may be provided for data download from the driver or upload from a base station. Cellular technology may also be accommodated for the user, with a speaker 241 and microphone 243 positioned at housing 29 or any of the driver modules. Real time video may be provided at video unit 245 (and downloaded or stored with appropriate in-situ memory), allowing remote review of operations and/or a record of completed tasks.

Figure 13:
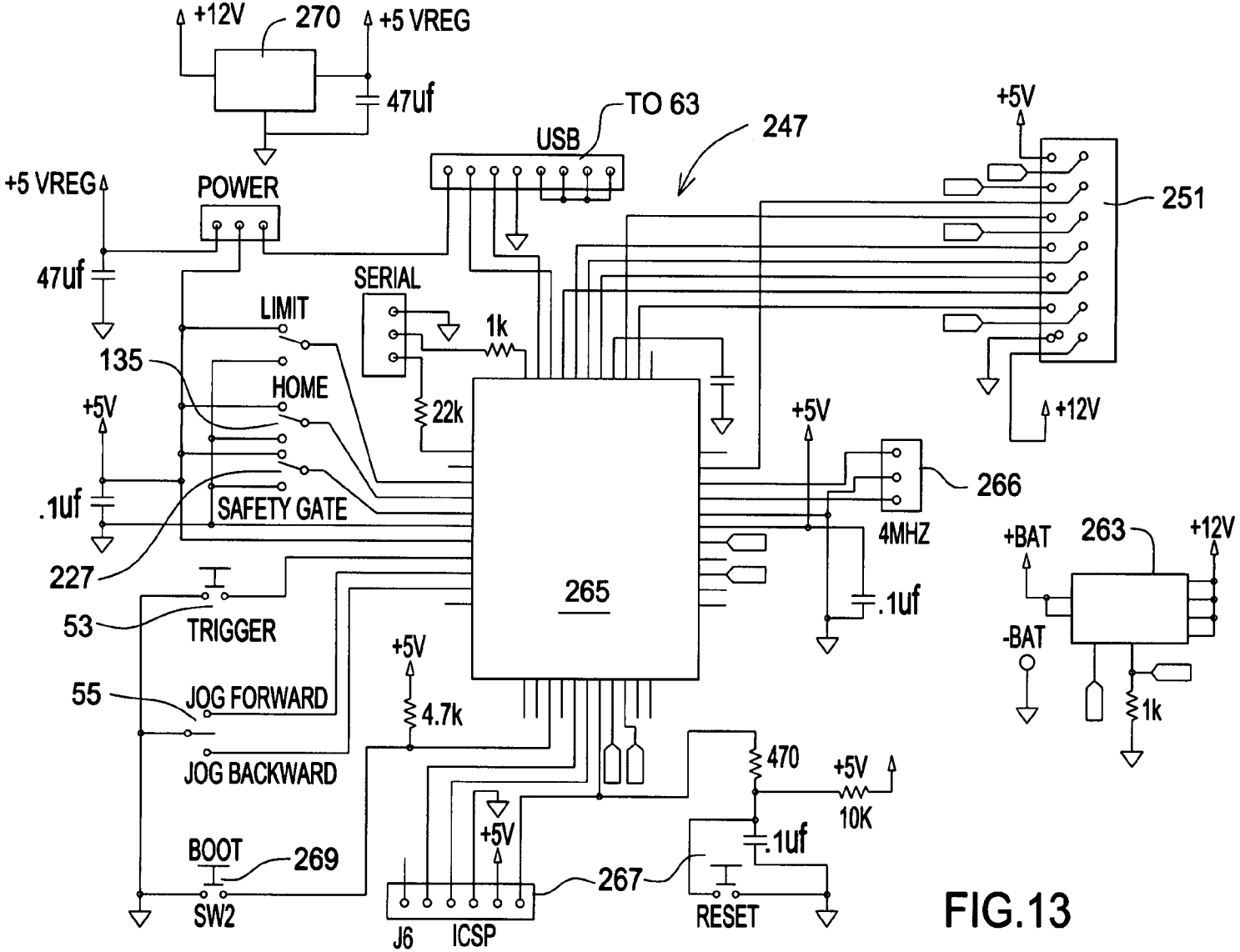
FIGS. 13 through 15 are schematic diagrams showing the electronics of the driver of this invention.
Figure 14:
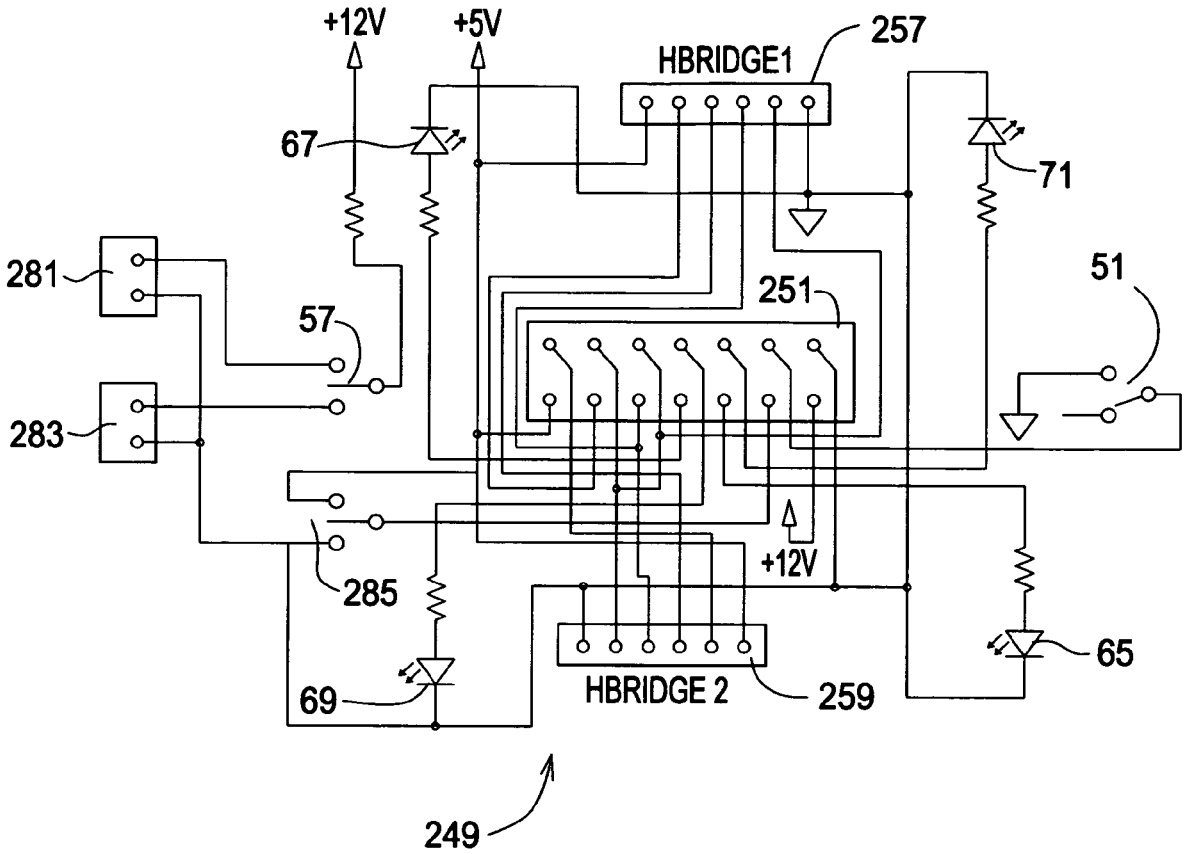
Figure 15:
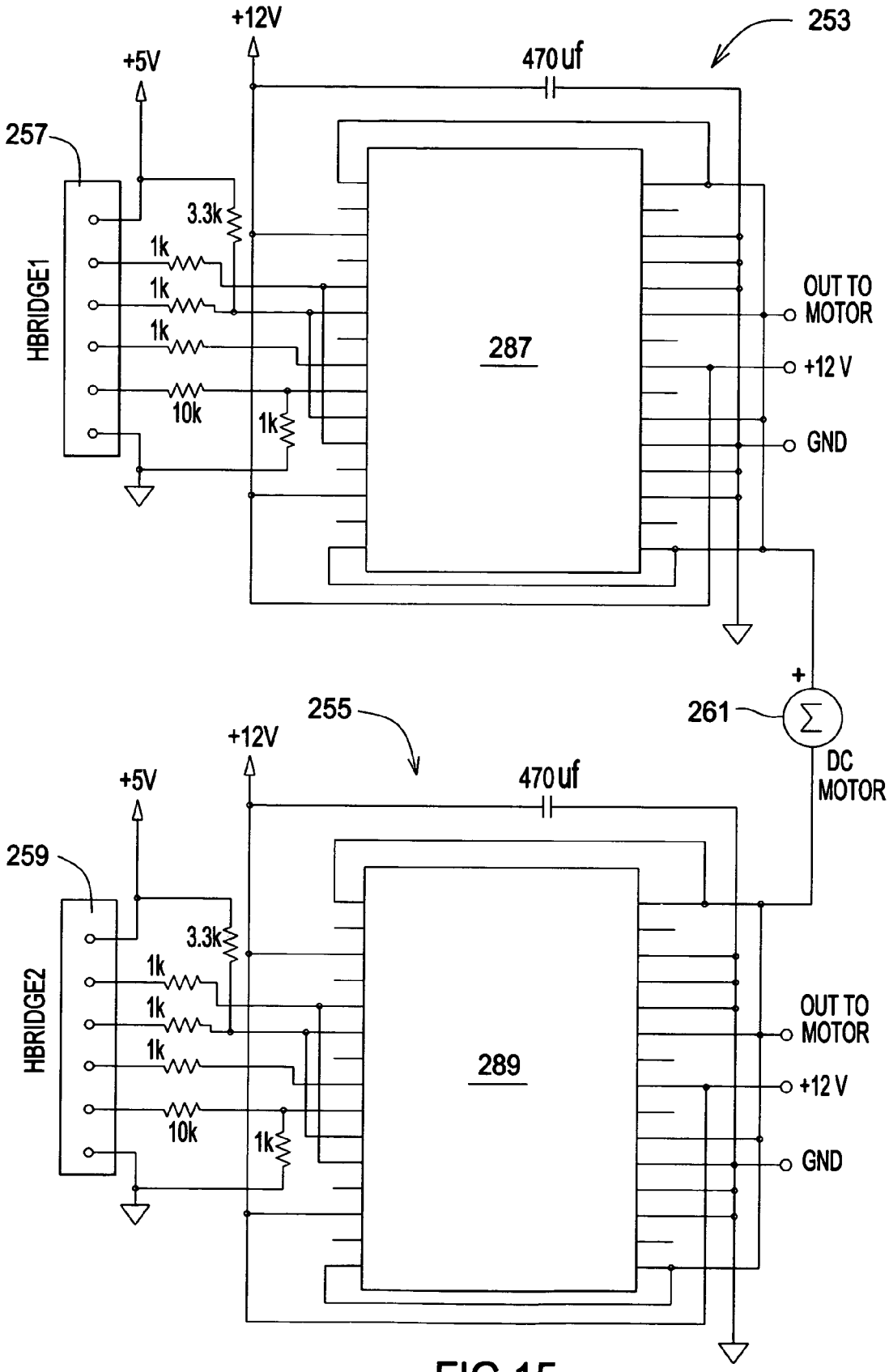

FIGS. 13 through 15 illustrate the electronic implementation of driver 21 of this invention, the boards described hereinafter housed in module 26. Main control board 247 (FIG. 13) is connected with switching board 249 (FIG. 14) at port connectors 251. Board 249 is connected with the two one-half h-bridge circuits 253 and 255 at connectors 257 and 259 (FIG. 15), the h-bridge circuits driving motor 261 (housed at module 25) in a conventional arrangement. Main board 247 includes a smart highside current power switch arrangement 263 (for example, a PROFET BTS660P by INFINEON TECHNOLOGIES) and a Flash USB ready microcontroller 265 (for example, a PIC18F2455/2550/4455/4550 series 28/40/44 pin microprocessor by MICROCHIP TECHNOLOGY, INC.) connected with clock oscillator 266. USB signals are accommodated at the connector to USB port 63.

Programming/reset circuits 267 are provided for programming and trouble shooting with programming switch 269 (modes may include everything from fully manual to fully automated), and voltage regulation is provided by regulator circuit 270. Momentary rocker switch 55 with center off provides for input to controller 265 of jog functions, and trigger switch 53 inputs running commands. Safety gate switch 227 inputs run ready signals, and rotation counter switch 135 inputs socket rotation count/location data.

Connectors 281 and 283 at switching board 249 are connected with lights 61 and 59, respectively, for operations responsive to switch 57 actuation. Switch 285 is a mode selection switch (manual or auto). On/off switch 51 signals are input through, and motor control signals are output through, board 249. H-bridge circuits 253 and 255 include integrated motor drivers 287 and 289, respectively (for example, VNH2SP30-E drivers from ST).

As may be appreciated, this invention provides a highly adaptable driver for precise manipulation of threaded connectors that employs location specific switching to accomplish reliable connector tightening. The gap probing techniques discussed herein (their particular location and the triggering embodiments shown in the FIGURES) are illustrative, it being understood that a variety of probing means and relative positions of switches and triggering related to location specific on/off switching could be utilized. By way of example, switch location could be anywhere along a mechanical probe or at either end, and probing could be conducted mechanically (as shown), electronically, magnetically or optically. Switches, likewise, could be mechanical (as shown) or sensory (optical, magnetic, electronic, etc.), or embodied in software. One particularly useful alternative replaces limit switch 187/177 with a linear resistor to regulate motor speed (to regulate nut to body gap closure speed at different stages of the traversed distance) as well as motor shut off.

What is claimed is:

1. A powered driver for rotating a threaded connector, the driver comprising:

a head housing a drive transfer assembly operating a rotatable socket engageable at the threaded connector;

means for applying motive force to said drive transfer assembly;

a reaction unit engageable at a utility related to the threaded connector, said reaction unit movably maintained at said head and biased toward said rotatable socket at least during rotation of an engaged threaded connector in one direction; and switching with components associated with both said reaction unit and said head that are operatively associated to provide triggering at selected relative location of said reaction unit and said head to decouple said means for applying motive force.

2. The driver of claim 1 wherein said switching includes a probe held at one of said reaction unit and said head and extending through the other of said reaction unit and said head, and a link at said other of said reaction unit and said head positioned to be contactable by said probe.

3. The driver of claim 2 wherein said link is a roller switch.

4. The driver of claim 2 wherein said probe length is adjustable.

5. The driver of claim 1 further comprising a controller and user actuatable controls for user selectivity of operational modes, direction and extent of rotation of said socket.

6. The driver of claim 1 wherein said rotatable socket is a split socket, said driver further comprising means for selectively rotating said split socket to a selected line release position.

7. The driver of claim 1 wherein said means for applying motive force is an electric motor, said driver further comprising torque amplifying drive train modules between said motor and said drive transfer assembly at said head.

8. A powered driver for line fittings comprising:

a head housing a rotatable socket;

a motor operatively associated with said rotatable socket;

a reaction unit including a fitting engagement attached to at least one rail guide movably maintained through said head;

at least a first biasing unit maintained at said head and operatively associated with said rail guide of said reaction unit to bias said fitting engagement of said reaction unit toward said rotatable socket;

a probe connected to said reaction unit; and a switch operatively associated with said motor and mounted at said head at a position to be contactable by said probe.

9. The driver of claim 8 wherein said probe is receivable through an opening at said head.

10. The driver of claim 8 further comprising a cam associated with said rotatable socket and a follower operative with said cam and connected to a switch for determining individual rotations of said socket.

11. The driver of claim 10 further comprising a controller and user actuatable controls for user selectivity of operational modes, direction and extent of rotation of said socket, and data accumulation.

12. The driver of claim 8 further comprising a pneumatic reaction unit reset operatively associated with said reaction unit and said biasing unit.

13. The driver of claim 8 further comprising a safety switch at said head allowing motor actuation only when a line fitting is correctly positioned at said driver.

14. A method for reliably repeatable rotation of threaded line fitting nuts to a selected tightness comprising:

engaging the nut at a rotatable socket and rotating the nut in one direction;

engaging another part of the line fitting at a reaction unit movably maintained adjacent to the socket and biasing the reaction unit toward the socket during rotation of the engaged nut in said one direction;

gauging relative location of the reaction unit and the socket during rotation in said one direction; and responsive to said gauging, causing cessation of rotation when a selected relative location of the reaction unit and the socket is achieved corresponding to selected nut tightness.

15. The method on claim 14 further comprising the step of momentarily automatically reversing direction of rotation after cessation of rotation in said one direction to thereby relieve system tension without changing nut torque.

16. The method of claim 14 further comprising the step of sensing correct positioning of said line fitting at the socket before enabling rotation of said socket in said one direction.

17. The method of claim 14 wherein the step of gauging relative location includes probing distance between the reaction unit and the socket during rotation in said one direction.

18. The method of claim 17 wherein the step of probing distance includes attaching a probe to the reaction unit and selectively adjusting relative length of said probe.

19. The method of claim 18 wherein the step of causing cessation of rotation includes contact by said probe with a switch maintained adjacent to the socket.

20. The method of claim 14 further comprising pneumatically resetting position of said reaction unit after cessation of rotation.

* * * * *